United States Patent [19]

Wells

[11] Patent Number: 5,018,545

[45] Date of Patent: May 28, 1991

[54] APPARATUS FOR CLEANING INTERIOR OF A LATERAL PIPELINE

[75] Inventor: Jeff P. Wells, Memphis, Tenn.

[73] Assignee: Insituform of North America, Inc., Memphis, Tenn.

[21] Appl. No.: 467,376

[22] Filed: Jan. 19, 1990

[51] Int. Cl.[5] ..... B08B 9/04

[52] U.S. Cl. ..... 134/113; 134/167 C

[58] Field of Search ..... 134/113, 167 C, 168 C; 15/104.33, 406; 118/306

[56] References Cited

U.S. PATENT DOCUMENTS

| | | | |
|---|---|---|---|
| 1,824,924 | 9/1931 | Paul et al. | 15/104.33 |
| 2,163,947 | 6/1939 | Hochberger | 15/104.33 |
| 3,522,815 | 8/1970 | Prange | 134/167 X |
| 3,655,122 | 4/1972 | Brown et al. | 134/167 X |
| 3,658,589 | 4/1972 | Shaddock | 134/168 X |
| 3,859,687 | 1/1975 | Caperton | 15/104.33 |
| 4,434,115 | 2/1984 | Chick | 264/36 |
| 4,677,472 | 6/1987 | Wood | 358/100 |
| 4,827,953 | 5/1989 | Lee | 122/392 X |

FOREIGN PATENT DOCUMENTS

| | | | |
|---|---|---|---|
| 1315411 | 12/1962 | France | 134/168 C |

*Primary Examiner*—Philip R. Coe

*Attorney, Agent, or Firm*—James & Franklin

[57] ABSTRACT

A pipeline extending laterally from a main pipeline is cleaned from the main pipeline by utilizing a nozzle with rearwardly oriented exit orifices through which fluid is forced, the jet effect of the escape of the fluid from those orifices providing the impetus to force the nozzle through the lateral pipeline so as to penetrate and physically clear away obstructions, the escaping fluid flowing through and cleaning the lateral pipeline.

6 Claims, 3 Drawing Sheets

APPARATUS FOR CLEANING INTERIOR OF A LATERAL PIPELINE

This invention relates to apparatus for cleaning lateral pipelines from the main pipeline with which they communicate.

Lateral pipelines commonly extend from main pipelines in order to provide communication between the main pipeline and a station remote therefrom, such as a domestic dwelling. Frequently there is a need to clean the interior of those lateral pipelines, which, because they need not carry the volume of fluid that the main pipeline must carry, are usually of smaller diameter than the main pipeline and thus more easily clogged, as for example by debris or material deposited from the fluid passing there through. Hence there is a need for apparatus which will clean such lateral pipelines. In addition, the lateral pipelines, like any pipeline, often develop leaks which require repair, as by lining or relining, and it is usually desirable to clean the pipeline before such repair is carried out.

When a lateral pipeline is to be cleaned, it is important that cleaning be accomplished from the main pipeline and not from the other, e.g. dwelling, end of the lateral pipeline, because access to that lateral pipeline from a domestic dwelling is in the majority of cases unacceptable to the occupier of the dwelling. Apparatus is available for obtaining access to lateral pipelines from the main pipeline for purposes of inspection and/or lining thereof, such as those disclosed in Chick U.S. Pat. No. 4,434,115 of Feb. 28, 1984 entitled "Method for Remote Lining of Side Connections" and Wood U.S. Pat. No. 4,677,472 of Jun. 30, 1987 entitled "Apparatus for Inspecting the Interior of a Pipeline," as well as patent application Ser. No. 396,238, filed Aug. 21, 1989 by myself and F. Thomas Driver and entitled "Method and Apparatus for Repair-Lining of Short Sections of Pipe." Those documents and others of the same general character disclose various means for causing the operative elements, be it TV camera or lining, to enter and move along the length of the side (lateral) pipe. Those means, while appropriate to the particular operations with which they are associated, are relatively complex and cumbersome, unnecessarily so in connection with cleaning of the interior of the side pipe, and they are also in many instances insufficiently positive in operation when the element being moved through the side pipe meets with an obstruction.

In accordance with the present invention, a nozzle means is employed to pass through a side pipe from the main pipe and to penetrate obstructions in an clean the side pipe, all in a simpler yet more effective manner than has previously been employed for that purpose. To that end, the said pipeline cleaning element comprises a nozzle having generally rearwardly directed exit orifices, which nozzle is connected to a hose through which fluid under pressure is delivered to the nozzle. That fluid, when it escapes from the exit orifices of the nozzle, produces a jet effect which forcefully propels the nozzle along the side pipeline, pulling the hose along with it, with sufficient force to penetrate or push aside obstructions in the side pipeline. The exiting fluid, after it leaves the nozzle, flows through the side pipeline into the main pipeline, thus itself providing a significant cleaning effect.

The nozzle with hose attached is moved into position in registration with the side pipeline to be cleaned by being mounted on a support moved through the main pipeline in known fashion, that support preferably having a tube, the forward portion of which is oriented to substantially correspond to the inclination of the side pipeline relative to the main pipeline, the nozzle initially being located on the forward end of that tube and the hose connected to the nozzle passing freely through the tube. Thus the nozzle is initially so positioned that when the jet effect of the fed fluid commences that nozzle is projected into the side pipeline at an optimum angle relative thereto.

It is the prime object of the present invention to devise a significantly improved apparatus for enabling lateral pipelines to be cleaned from the main pipeline.

It is a further object of the present invention to devise such an apparatus which is not only simple and extraordinarily effective but which in addition utilizes in the main structural elements and equipment already available in connection with pipe inspection, cleaning and relining operations, thereby minimizing capital costs and facilitating operation by personnel already experienced in pipe relining operations.

To the accomplishment of the above, and to such other objects as may hereinafter appear, the present invention relates to apparatus for cleaning the interior of a lateral pipeline, as defined in the following claims and as described in this specification, taken together with the accompanying drawings in which:

Figure 1:
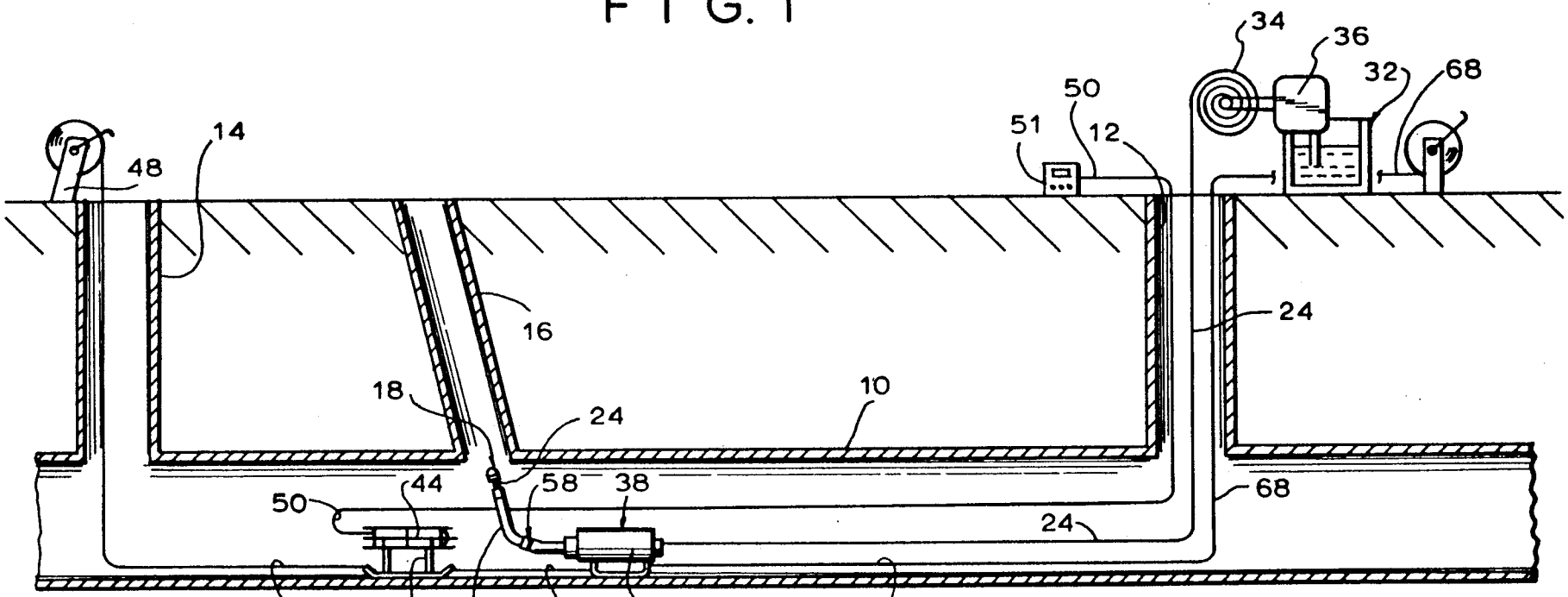
FIG. 1 is a diagramatic view of a main pipeline and lateral pipelines and the manner in which the apparatus of the present invention is used in conjunction therewith.
Figure 4:
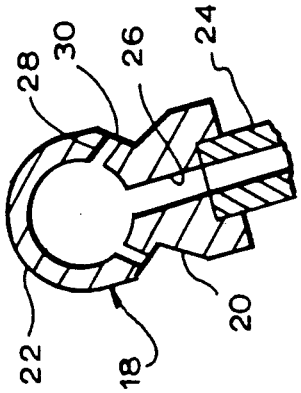
FIG. 4 is a cross-sectional view through the nozzle.

Referring to the drawings, an underground pipeline 10 is shown as extending between upstream and downstream access openings 12 and 14, which may be manhole openings. Communicating with the main pipe 10 is a lateral connecting pipeline 16 extending from the main pipeline 10 at an angle and continuing to some remote location. The objective is to clean the interior of lateral pipeline 16 from the main pipeline 10. That cleaning is to be effected by pushing through the lateral pipeline 16 a nozzle element generally designated 18 which, as it moves along the length of the pipe 16, cleans the interior of the latter. That element 18 comprises a substantially rigid body 20 preferably having a generally tapered forward end 22, the body 20 being secured to the end of a flexible hose 24 and having in its interior and in communication with the hose 24 a forwardly extending fluid passage 26 which diverges into a plurality of generally rearwardly extending passages 28 terminating in generally rearwardly oriented exit orifices 30. The hose 24 extends from the element 18 to a remote station generally designated 32, preferably located above-ground adjacent the access opening 12, where it is mounted on a reel 34 from which it may be paid out and reeled in, the end of the hose 24 being operatively connected to a source 36 of fluid, usually water, under pressure which fluid is forced through the hose 24 to the element 18 so as to flow through the hose 24 to the element 18 then through the passages 26 and 28, and there to escape through the exit orifices 30.

In order to located the element 18 at a point in the main pipeline 10 from which it can enter the lateral pipeline 16 a support generally designated 38 is provided on which the element 18, with its attached hose 24, is mounted. That support 38 may be connected by line 40 to a second support 42 on which a TV camera 44 is mounted, a line 46 extending from the support 42 to and through the access opening 14 where it is wound on to a reel 48. An electrical line 50 extends from the TV camera 44 to a viewing apparatus 51 at an external station such as the station 32. By winding the line 46 on the reel 48 the supports 38 and 42 are pulled along the main pipeline 10, into which they have been introduced via the access opening 12, until the element 18 is moved into position in registration with the lateral pipeline 16 to be cleaned.

The support 38 may comprise a rigid cylinder 52 with hollow guide portions 54 and 56 at the trailing and leading ends thereof respectively. Secured to the guide portion 56 is a tube generally designated 58 having a first portion 60 extending substantially axially from the portion 56 and leading into an upwardly inclined portion 62. Secured to the portion 62, as by being telescoped thereinto, is a bent tube 64, the orientation of which relative to the axis to the main pipeline 10 when the apparatus is in place more or less corresponds to the inclination that the lateral pipeline 16 makes with that main pipeline 10. The element 18 is located beyond the tip of the tube 64 and it is attached to hose 24, which is freely slidable through the tubes 64 and 62 and the housing 38.

Figure 2:
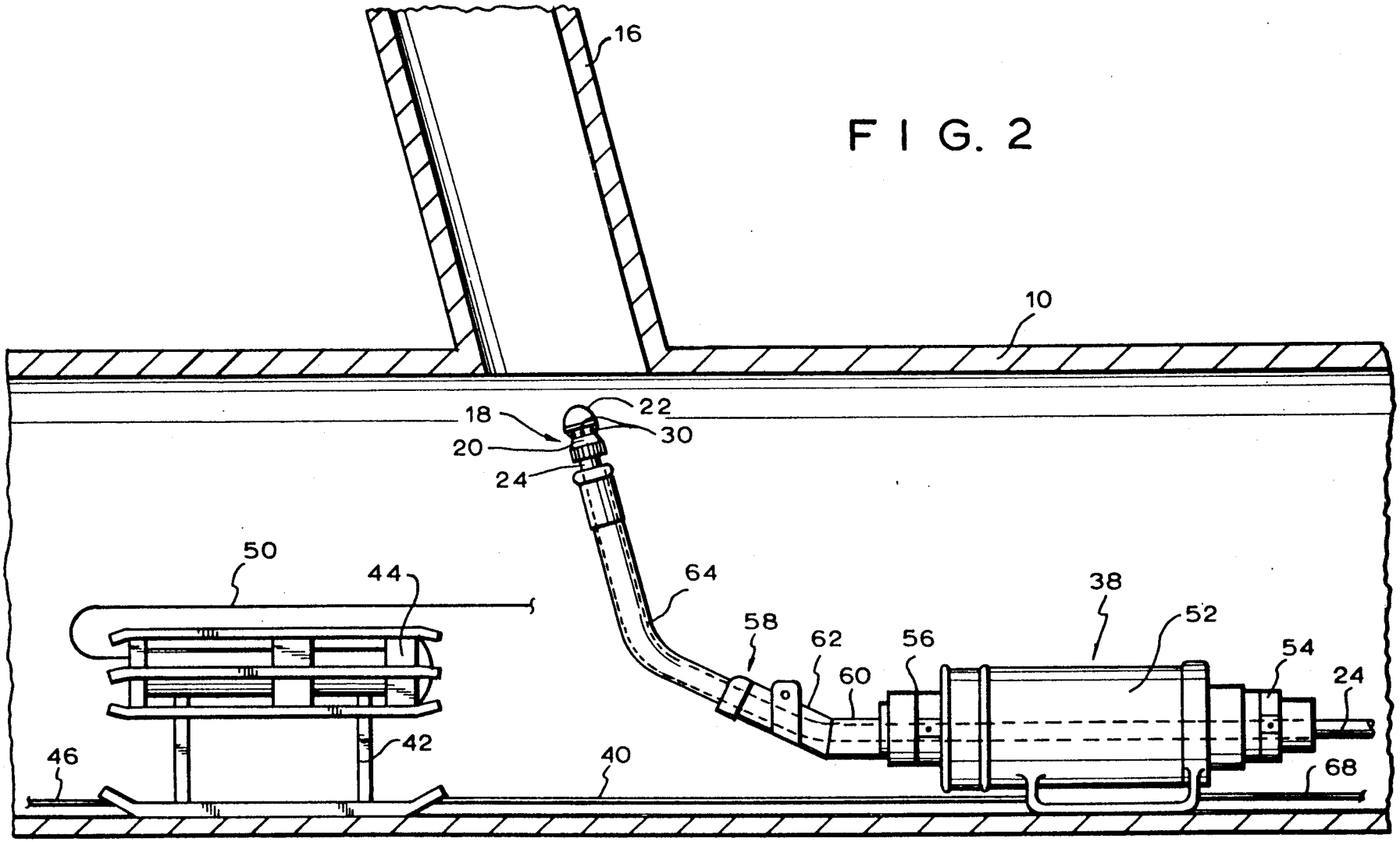
FIG. 2 is a side elevational view of the apparatus of the present invention in position prior to entering the lateral pipeline.
Figure 3:
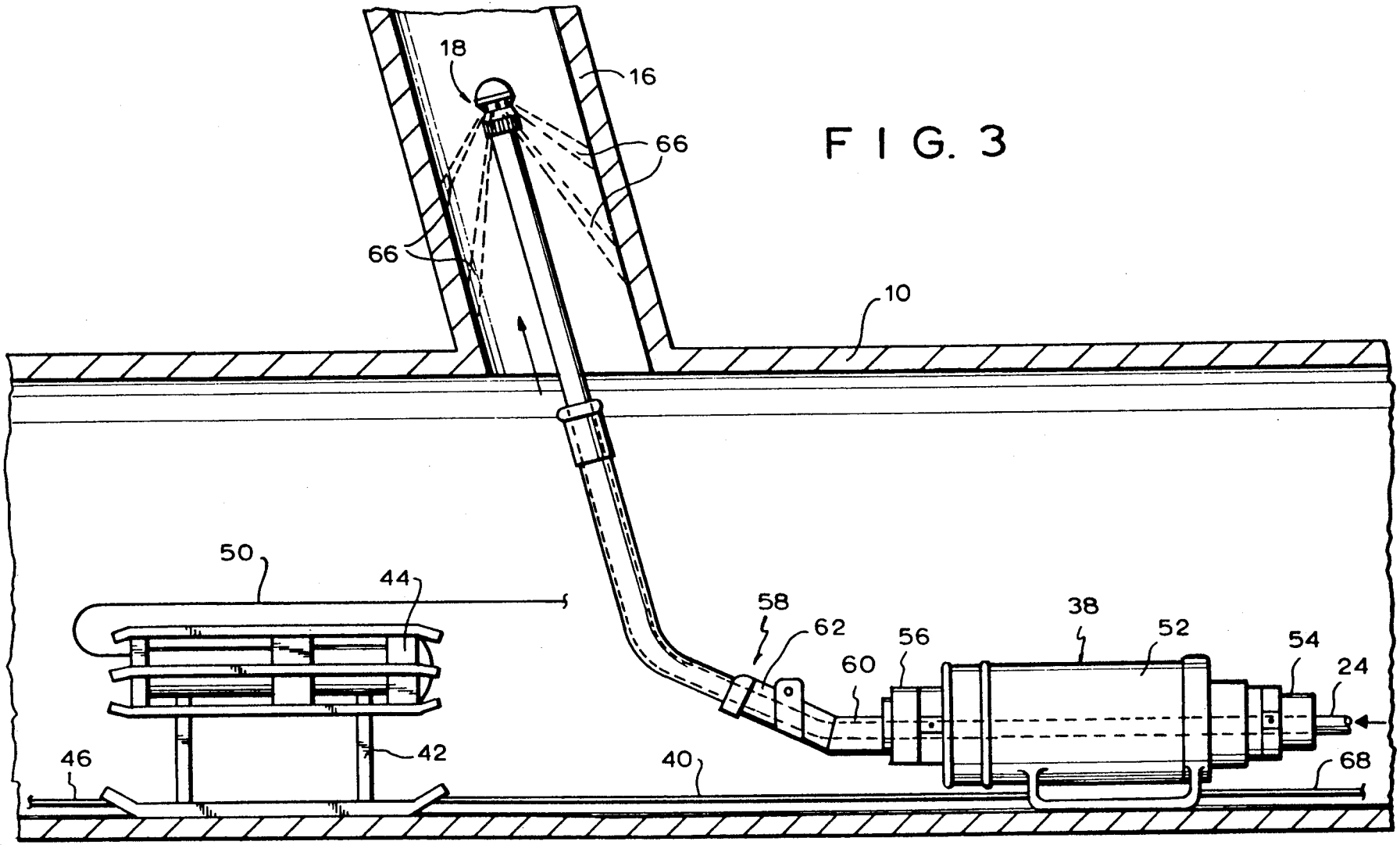
FIG. 3 is a view similar to FIG. 2 but showing the apparatus with the nozzle having entered and proceeding along the length of the lateral pipeline.

After the apparatus as thus described has been moved into position with the element 18 essentially in line with the lateral pipeline 16, as shown in FIG. 2, fluid, preferably water, is forced through the hose 24 and the passages 26 and 28 to exit from the exit openings 30 in the form of generally rarwardly oriented jets 66 (see FIG. 3). The reaction between these jets and the element 18 propels that element into and along the lateral pipeline 16 with appreciable force, and that force, functioning together with the generaly tapered nature of the tip 22 of the element 18, will cause the element 18 to penetrate most obstructions in the lateral pipe 10 that it may be expected to encounter. In the course of that movement the element 18 will also more or less randomly engage with the inner surfaces of the lateral pipeline 16, thereby being effective to dislodge matter which may have attached itself to those walls. In addition, the flow of fluid emanating from the element 18 will flow through the lateral pipeline 16 to the main pipeline 10, thus providing a cleaning effect effective to wash loose material out from the lateral pipeline 16.

The operator can control the pressure with which the fluid is provided to the element 18, thereby to control the speed with which the element 18 moves along the lateral pipe 16, which speed is apparent to the operator at the remote station 32 as he observes the hose 24 paying out, and the operator can also adjust the pressure so as to increase the penetrating force that the element 18 exerts on an obstruction so that the desired penetration of the obstruction can be accomplished. The speed with which the element 18 moves along the lateral pipeline 16 can also be controlled by frictionally braking the reel 34 on which the hose 24 is wound. The operator can increase the pressure of the fluid being fed when the element 18 meets a particular resistant obstacle, thereby to penetrate the obstacle or dislodge it from the interior surface of the lateral pipeline 16. In addition, the element 18 can be stopped at any point along the length of the lateral pipe 16 by locking the reel 34 against rotation while fluid is still supplied to the element 18 in order to prolong the washing action whereever that may be deemed appropriate. Thus, the operator may readily control the various aspects of the side pipeline cleaning operation in order that the cleaning operation will have optimum results.

After the cleaning operation has been completed, the flow of fluid through the hose 24 will be cut off and the hose 24 will be wound on to the reel 34, that hose sliding freely through the tube 58 and support 38 until the element 18 is once again close to the tip of the tube portion 64. Then, by means of the line 68 attached to a support 38 and extending to the remote station 32, the entire cleaning assembly consisting of the support 38 and the TV camera 44 is pulled back through the main pipeline 10 and removed therefrom via the access passage 12.

The tube 58 has been hereto disclosed as rigid, that perhaps being preferable in order to insure that the element 18 carried thereby is reliably pointed in the right direction toward the mouth of the lateral pipeline 16. When such a rigid tube 58 is employed a series of differently configured tubes will preferably be available so that the tube most closely corresponding to the orientation of the lateral pipeline 16 to be cleaned will be selected for use and attached to the guide portion 56. Alternatively, the tube 58 could be articulate, particularly as between its portions 62 and 64, with clamping means appropriate operatively connected to those parts so that their relative orientation can be adjusted and then fixed.

While but a single embodiment of the present invention has been here disclosed, it will be apparent that many variations may be made therein, all within the scope of the invention as defined in the appended claims.

I claim:

1. Apparatus for cleaning a side pipe diverging in a given direction from a main pipe, said apparatus comprising a support movable along said main pipe and carrying a tube extending therefrom and having a leading portion oriented relative to said main pipe substantially similarly to said given direction, an elongated hose longitudinally mounted in and slidable through said tube, having a trailing end extending from said support through said main pipe to a remote operating station, and having a leading end, a cleaning element secured to said leading end and positioned substantially externally of said tube, said cleaning element being of a size to fit loosely within said side pipe and having fluid passages therein communicating between said hose and exit orifices oriented substantially rearwardly with respect to the leading end of said element, and means for supplying fluid under pressure through said hose and said passages inside said cleaning element, whereby the exiting of said fluid through said exit orifices of said cleaning element propels said cleaning element along said side pipe, pulling said hose along with it, in which said support comprises a hollow body to which said tube is detachably connected.

2. The apparatus of claim 1, in which the leading end of said cleaning element is tapered.

3. The apparatus of either of claims 1 or 2, in which said hose passes slidably through said body.

4. The apparatus of either claims 1 or 2, further comprising a TV camera connected to an movable with said support and operatively connected to a remote viewing station, whereby the proper positioning of said cleaning element relative to the side pipe to be cleaned can be observed.

5. The apparatus of claim 4, in which said hose passes slidably through said body.

6. The apparatus of any of claims 1, 2 or 5, in which said tube is rigid.

* * * * *